US008581741B2

(12) United States Patent
Simpson et al.

(10) Patent No.: US 8,581,741 B2
(45) Date of Patent: Nov. 12, 2013

(54) COMMUNICATION SYSTEM FOR A HYDROCARBON EXTRACTION PLANT

(75) Inventors: Steven Lewis Charles Simpson, Bristol (GB); Peter John Davey, Weston Super Mare (GB)

(73) Assignee: Vetco Gray Controls Limited, Nailsea, Bristol (GB)

( * ) Notice: Subject to any disclaimer, the term of this patent is extended or adjusted under 35 U.S.C. 154(b) by 561 days.

(21) Appl. No.: 12/936,226

(22) PCT Filed: Mar. 31, 2009

(86) PCT No.: PCT/GB2009/000860

§ 371 (c)(1),
(2), (4) Date: Oct. 4, 2010

(87) PCT Pub. No.: WO2009/122168

PCT Pub. Date: Oct. 8, 2009

(65) Prior Publication Data

US 2011/0025526 A1 Feb. 3, 2011

(30) Foreign Application Priority Data

Apr. 4, 2008 (GB) ..... 0806095.6

(51) Int. Cl.
*G01V 3/00* (2006.01)

(52) U.S. Cl.
USPC ..... 340/854.6; 340/853.1; 166/336; 166/366

(58) Field of Classification Search
USPC ..... 340/854.6, 853.1; 166/336, 366
See application file for complete search history.

(56) References Cited

U.S. PATENT DOCUMENTS

| | | | | |
|---|---|---|---|---|
| 6,575,248 | B2 * | 6/2003 | Zhang et al. | 166/338 |
| 6,798,338 | B1 | 9/2004 | Layton | |
| 7,187,623 | B2 * | 3/2007 | Green et al. | 367/133 |
| 7,261,162 | B2 * | 8/2007 | Deans et al. | 166/336 |
| 7,301,474 | B2 * | 11/2007 | Zimmerman | 340/854.6 |
| 7,347,271 | B2 * | 3/2008 | Ohmer et al. | 166/366 |
| 7,400,977 | B2 * | 7/2008 | Alumbaugh et al. | 702/7 |
| 7,477,160 | B2 * | 1/2009 | Lemenager et al. | 340/853.1 |
| 7,921,916 | B2 * | 4/2011 | Lovell et al. | 166/336 |
| 2003/0098799 | A1 | 5/2003 | Zimmerman | |
| 2004/0124994 | A1 | 7/2004 | Oppelt | |
| 2006/0159524 | A1 | 7/2006 | Thompson | |

FOREIGN PATENT DOCUMENTS

| | | | |
|---|---|---|---|
| GB | 2163029 | A | 2/1986 |
| GB | 2377131 | B | 1/2006 |
| GB | 2458944 | A | 7/2009 |
| GB | 2458011 | A | 9/2009 |
| WO | 2005078233 | A1 | 8/2005 |
| WO | 2006134331 | A1 | 12/2006 |

OTHER PUBLICATIONS

GB Search Report dated Apr. 23, 2012 from corresponding Application No. GB0806095.6.

(Continued)

*Primary Examiner* — Albert Wong
(74) *Attorney, Agent, or Firm* — Bracewell & Giuliani LLP

(57) ABSTRACT

A method of enabling communication between components of a hydrocarbon extraction plant, the plant having an underwater hydrocarbon extraction installation including at least one hydrocarbon extraction well with an associated tree, comprises providing a plurality of RF communication means at respective components of the installation.

19 Claims, 2 Drawing Sheets

(56) References Cited

OTHER PUBLICATIONS

Figure 1:
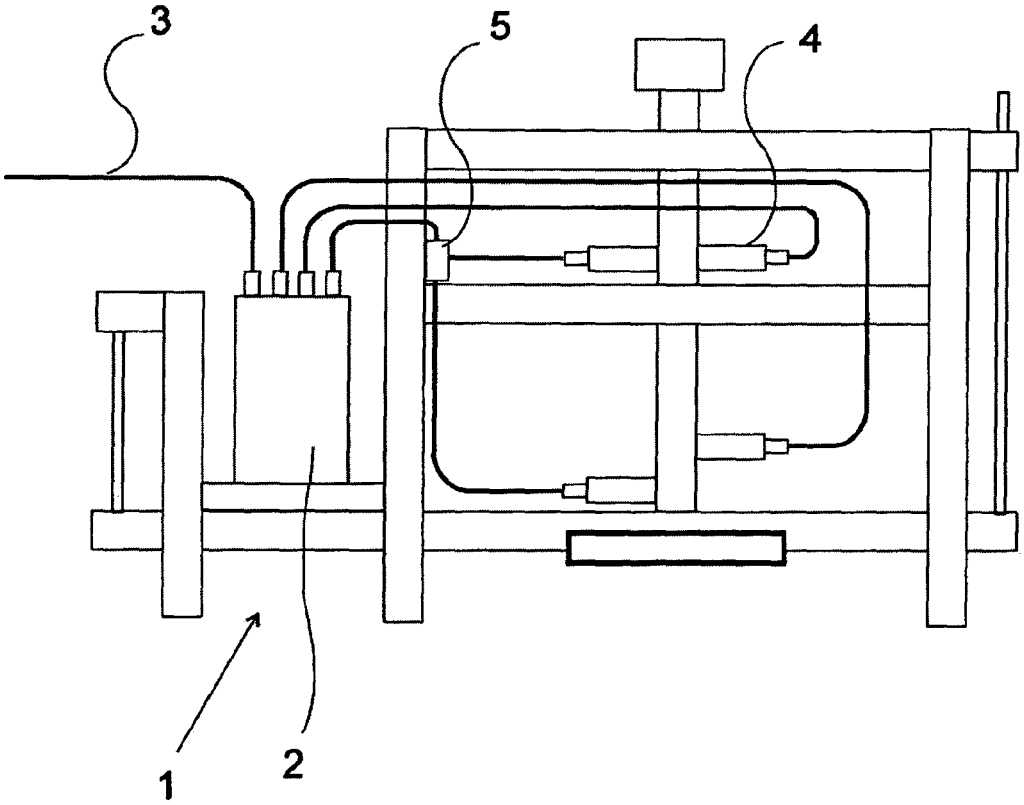

ABB Review: "To the last drop" Internet Article, [online] Jan. 2008, pp. 63-66, XP002532134 Internet Retrieved from the Internet: URL:http://www.abb.com/abbreview> [retrieved on Jun. 12, 2009] the whole document.
International Search Report Jun. 24, 2009 issued in PCT/GB2009/000860.
Search Report Aug. 1, 2008 issued in GB0806095.6.
Egil Birkemoe et al., To the last drop, ABB ReviewJan. 2008.
GB0806095.6, Intellectual Property Office UK and Written Opinion, Jan. 22, 2011.
Examination Report dated Feb. 20, 2012, for related application GB0806095.6 and Response filed on Mar. 9, 2012.
R. Somaraju, et al., "Frequency, Temperature and Salinity Variation of the Permittivity of Seawater, IEEE Transactions on Antennas and Propagation," vol. 54, No. 11, Nov. 2006.
Notification of Grant dated May 29, 2012 for related application GB0806095, now GB2458944B.

* cited by examiner

COMMUNICATION SYSTEM FOR A HYDROCARBON EXTRACTION PLANT

RELATED APPLICATION

This application claims priority to PCT application PCT/GB2009/000860 filed Mar. 31, 2009 which claimed priority to British patent application GB 0806095.6, filed Apr. 4, 2008.

This invention relates to a method of enabling communication between components of a hydrocarbon extraction plant, the plant having an underwater hydrocarbon extraction installation including at least one hydrocarbon extraction well with an associated tree, and a hydrocarbon extraction plant having an underwater hydrocarbon extraction installation including at least one hydrocarbon extraction well with an associated tree.

Communication between a topside facility of a hydrocarbon extraction plant and Subsea Control Modules (SCMs) at an underwater hydrocarbon extraction installation of the plant, for example at a "Christmas tree" associated with a hydrocarbon extraction well, is currently effected by the use of copper or fibre-optic cables within an umbilical line, which connects the topside communications equipment to the subsea field. Likewise, Subsea Production Control System process sensors, mounted on a subsea Christmas tree, manifold or other structure, are currently connected by copper wires to the Subsea Control Module (SCM). Both these types of connection require Electrical Flying Leads (EFLs). The capital, topside and subsea installation costs of EFLs forms a significant portion, approximately 15%, of the overall cost of a Subsea Production Control System suite of equipment. Due to the electro-mechanical nature of the connectors, combined with the need to be wet-mateable for recovery, for example, of SCMs and/or sensors, the reliability of EFLs has historically been poor. EFLs can also cause problems during Remote Operation Vehicle (ROV) operations such as the recovery of a failed SCM or the updating of software.

The topside to SCM umbilical line typically carries control and monitoring signals via a modem, whereas an SCM provides DC power and Fieldbus serial communications (e.g. Profibus, Modbus, CANBus, etc) to the sensors and relays the sensor data to the topside equipment via the umbilical.

A conventional Christmas tree 1 with connections between tree sensors, an SCM and topside (surface) facility is shown in FIG. 1. Electric power, control and monitoring signals are fed from a topside control platform via an umbilical 3 to an SCM 2, housing a Subsea Electronics Module (SEM), the SCM 2 being mounted on a subsea Christmas tree 1. The SCM 2 interfaces with tree process sensors 4 via EFLs and a junction box 5. The SCM also provides hydraulic control of valves and other devices, not shown on the figure.

It is an aim of the present invention to remove the need for most of the EFLs and their associated expensive electrical connectors for communication in a hydrocarbon extraction plant. This aim is achieved through the use of wireless radio frequency (RF) technology.

In accordance with a first aspect of the present invention there is provided a method of enabling communication between components of a hydrocarbon extraction plant, the plant having an underwater hydrocarbon extraction installation including at least one hydrocarbon extraction well with an associated tree, comprising the step of:

a) providing a plurality of RF communication means at respective components of the installation.

In accordance with a second aspect of the present invention there is provided a hydrocarbon extraction plant having an underwater hydrocarbon extraction installation including at least one hydrocarbon extraction well with an associated tree, comprising a plurality of RF communication means provided at respective components of the installation.

In accordance with a third aspect of the present invention there is provided a Subsea Control Module for use in such a plant, comprising RF communication means.

In accordance with a fourth aspect of the present invention there is provided a Remote Operation Vehicle for use in such a plant, comprising RF communication means.

In accordance with a fifth aspect of the present invention there is provided a sensor for use in such a plant, comprising RF communication means.

In accordance with a sixth aspect of the present invention there is provided a manifold for use in such a plant, comprising RF communication means.

In accordance with a seventh aspect of the present invention there is provided a choke for use in such a plant, comprising RF communication means.

In accordance with the present invention, wireless RF links may be employed between, for example, the topside platform and the SCM, the SCM and process sensors, an ROV and the underwater installation, and the underwater installation and downhole devices. This removes the relatively unreliable electro-mechanical EFL elements from the system and as potential obstacles during ROV operations.

Currently, the performance of wireless RF subsea communication is limited, with a reduced data rate with increase of range. Typically, current achievable data rates at a range of 200 meters are between 50 and 100 bits per second, and at a range of 2 meters between 1 and 10 Mega bits per second. Thus current technology satisfies the requirements between process sensors and the SCM, and between an ROV and the sensors or SCM. Current serial communications-based subsea Christmas tree/manifold sensors operate at between about 9.6 kb/s and 38.4 kb/s. These typically include pressure, temperature and combined pressure and temperature sensor types (both redundant and non-redundant versions). Current technology allows a communication distance between 10 and 50 meters, and since a typical subsea Christmas tree has dimensions of about 5 meters in each plane, wireless RF communication is achievable.

Between the platform and the subsea installation, direct wireless communication would currently be limited to relatively shallow water systems in sea water, although comparable data rates in freshwater systems are achievable at twice the depth of sea water. However, development of subsea wireless communication technology is advancing at a rapid rate and operational depths are expected to increase substantially in the near future. An alternative embodiment, overcoming the range and data rate limitations, employs strategically placed wireless repeaters between the platform and installation.

One of the functions of an ROV is to download software updates to, or reprogram, a Subsea Electronic Module (SEM) housed in the SCM, or the process sensors. The present invention enables special electrical connection harnesses to connect re-programming equipment to the SCM to be dispensed with. Furthermore, data rates may be much greater than the currently used, relatively slow, copper-based communications systems.

Since subsea wireless systems are able to penetrate the sea bed, the present invention may be extended to include wireless RF communication with downhole devices such as chokes and sensors. Additionally, it may provide communication with seabed seismic sensors spread over a field to provide life-of-field seismic information.

To eliminate EFLs by the use of a wireless RF system, it is necessary to provide a local power supply for the wireless RF communication means employed at the subsea installation. In a simple embodiment, each such communication means could include an associated battery. Alternatively, various of the RF communication means may be powered by an underwater power source, such as that described in a co-pending application.

Some systems include a manifold to couple the output of several wells to a single fluid extraction production pipeline, and such a manifold may be fitted with process sensors, and which may be remote from the Christmas tree. Communication between these process sensors and each other, and with the tree or other components of the plant, can also be achieved by wireless RF links.

The present invention provides many advantages over conventional systems as described above. These include:

Reliability

- Improved reliability due to the removal of electro-mechanical connections associated with the Electrical Flying Leads (EFL);
- A removal of the need for wet-mate SCM and EFL connections to sensors; and
- The reduced amount of cabling leads to a correspondingly reduced chance of snagging during ROV or other intervention equipment operations.

Cost Savings

- The inventive arrangement leads to fewer ROV operations (i.e. no SCM to Tree EFL operations);
- There are reduced costs due to the removal of different connector interfaces (e.g. SCM, EFL and sensor connectors); and
- The reduced connectors and cabling leads to reduced test requirements.

Reduced Installation Costs

- The removal of the main topside to subsea umbilical saves a significant proportion of the project cost.

Time Savings

- Fewer ROV operations are required during installation or retrieval of SCMs and/or sensors (i.e. no SCM to tree sensor EFL operations);
- It is possible to communicate with a sensor via the SCM without the need for specialist EFLs; and
- If the range between the topside and subsea equipment proves to be too great to permit the required data rate, then repeaters can still be deployed much more quickly and easily than an umbilical.

Other Benefits

- Wireless software downloads to sensors can be effected prior to deployment;
- Fast re-programming of a Subsea Electronics Module (SEM) in a Subsea Control Module (SCM) prior to deployment can be effected. This removes the need for special electrical connection harnesses to connect re-programming equipment to the SCM and speeds up SEM re-programming compared with a relatively slow copper-based communications system;
- Fast re-programming of a SEM in a SCM whilst installed on a Christmas tree can be achieved via an ROV or other suitable host which would again speed up SEM re-programming compared to a relatively slow copper-based communications system; and
- An ROV SEM could communicate with sensors whilst a subsea Christmas tree and/or manifold is being installed or operated, before a Production Control System is installed.

The RF communication employed by the present invention has various advantages over other forms of wireless communication, in particular acoustic communication. These include:

a) RF signals cross the water to air boundary;
b) RF signals do not need line-of-sight to reach their intended destination;
c) RF signals are able to propagate through ice;
d) RF signals are able to propagate through the seabed;
e) RF signals are immune to acoustic noise;
f) RF signals are immune to aerated water and high turbidity;
g) Generation of RF signals consumes less power compared to generation of acoustic signals; and
h) There are currently no known effects on marine life from RF signals.

The invention will now be described, by way of example, with reference to the accompanying drawings, in which:—

FIG. 1 schematically shows a conventional Christmas tree; and

Figure 2:
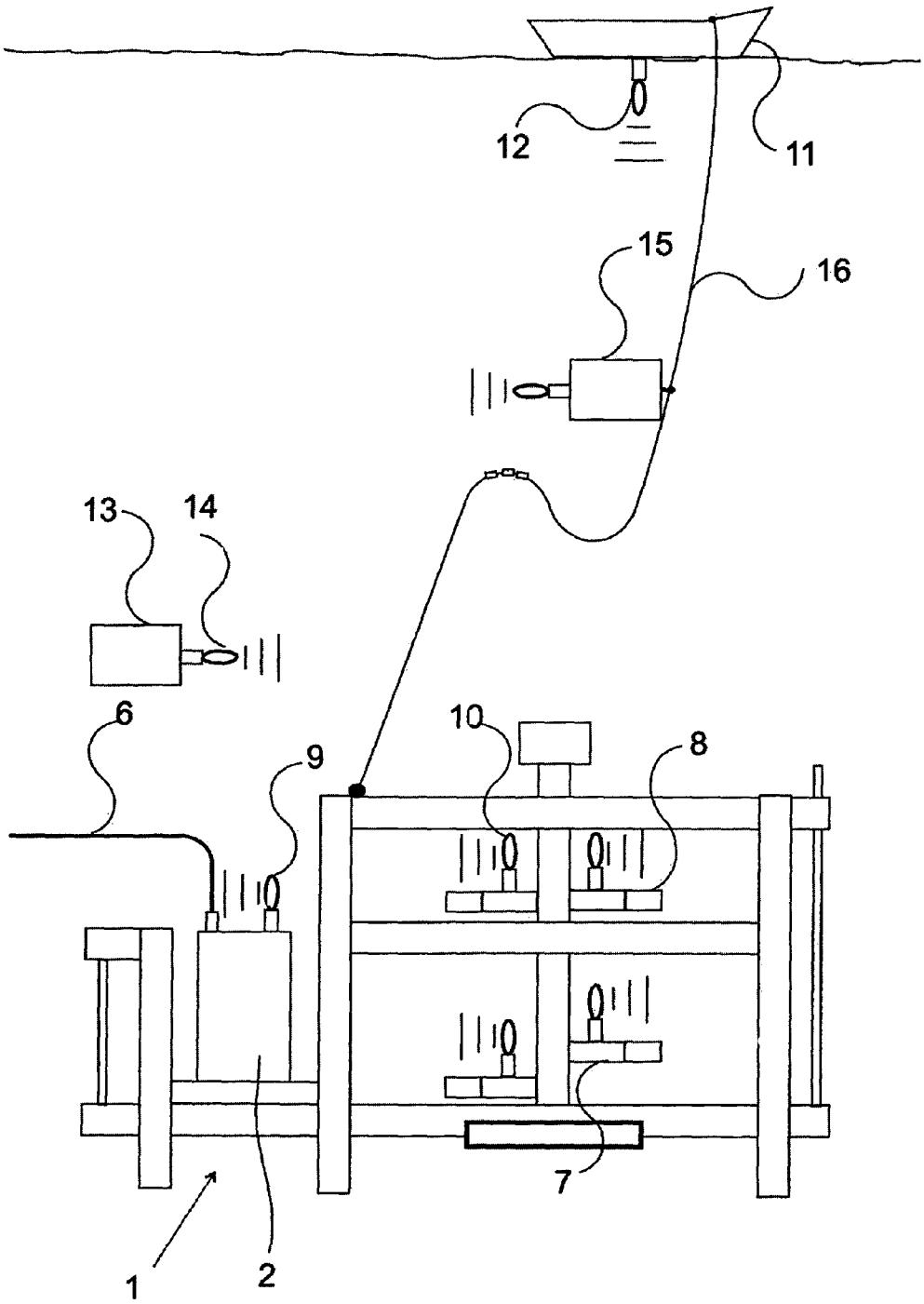

FIG. 2 schematically shows an exemplary hydrocarbon extraction plant in accordance with the present invention.

FIG. 2 shows a simple embodiment of the present invention, with a hydrocarbon extraction plant in which conventional communication EFLs are replaced by wireless RF links. As a result, no umbilical cable is required. Similarly to the arrangement shown in FIG. 1, a Christmas tree 1 is provided which includes an SCM 2 with an internal SEM. Electric power is supplied to the SCM 2 and the internal SEM by a subsea power source via a cable 6. A plurality of process sensors 7 is mounted on the tree, with each sensor 7 being powered by an associated battery 8. An interface between the SCM 2 and each of the process sensors 7 is achieved by wireless RF communication, via an RF antenna 9 mounted on the SCM 2, and an RF antenna 10 mounted on each of the process sensors 7. The extraction plant shown includes a topside facility, in this case a surface vessel or platform 11, which is also fitted with an RF antenna 12. The transmission of control signals and return of monitoring signals between the surface vessel 11 and the SCM 2 is achieved by a bi-directional wireless RF link via the antenna 12 and the antenna 9 mounted on the SCM 2. In the embodiment shown, a wireless repeater 15 is provided to facilitate transmission between the vessel 11 and SCM 2 when the distance between them is too great for direct transmission. A line 16 is provided between the vessel 11 and the tree 1, and the repeater 15 is anchored thereto at roughly the required depth. The line 16 shown is a low power, and therefore low cost, cable to provide electric power to the repeater from either the platform or the tree. In alternative embodiments, the repeater may be self-powered by, for example, an associated battery, in which case the anchor line 16 may be a non-conducting line. Additional repeaters 15 may be provided on line 16 as dictated by the distance between the vessel 11 and tree 1.

The plant shown also includes an ROV 13, which is also provided with a wireless RF antenna 14. The transmission of software updates and/or emergency control of the well may be achieved by wireless transmission from the ROV antenna 14 to either the SCM 2 or the process sensors 7, via their respective antennas 9 and 10. Since the ROV 13 can be located close to the Christmas tree 1, data transmission rates can be much higher than between the vessel 11 and the tree 1, allowing faster software updates than those achieved conventionally via EFLs.

Although not shown in the embodiment of FIG. 2, the plant may include a manifold, which may be remote from any Christmas trees, to couple the output of several wells to a single fluid extraction production pipeline. This manifold may be fitted with process sensors. Communication between these process sensors and each other, and with the tree or other components of the plant, can also be achieved by wireless RF links, by providing the process sensors with RF antennas.

The present invention enables channel separation to achieve individual communication links to be realised. This may be achieved by, for example, the use of different transmitting and receiving carrier frequencies, digital encoding, or spread spectrum techniques.

The above-described embodiment is exemplary only, and various other arrangements within the scope of the claims will be apparent to those skilled in the art.

What is claimed is:

1. A method of enabling communication between components of a hydrocarbon extraction plant through establishment of a radio frequency (RF) communication arrangement, the plant having an underwater hydrocarbon extraction installation including at least one hydrocarbon extraction well with an associated well tree, the method comprising the steps of:

providing a plurality of RF communication devices at a respective plurality of components of the installation, wherein said components comprise a subsea control module (SCM) at the tree, a sensor at the tree, a topside facility, and a remote operation vehicle;

providing an RF antenna at the SCM;

providing an RF antenna at the sensor;

providing an RF antenna at the topside facility; and providing an RF antenna at the remote operation vehicle, the RF communication arrangement providing for communication of the topside facility with the SCM, communication of the sensor with the SCM, and communication of the remote operation vehicle with the SCM or the sensor.

2. A method according to claim 1, wherein said components of the installation comprise each of the following: the SCM at the tree, a manifold to couple output of a plurality of wells, the sensor located at the tree, a downhole device located in the installation, the remote operation vehicle, and the topside facility.

3. A method according to claim 1, wherein one of said components of the installation further comprise a sensor located at a manifold provided to couple output of a plurality of wells.

4. A method according to claim 1, wherein one of said components of the installation comprises a sensor located at the installation, and wherein the sensor measures seismic activity.

5. A method according to claim 1, wherein one of said components of the installation comprises a downhole device located in the installation, and wherein the downhole device comprises a choke.

6. A method according to claim 1, further comprising:

providing a line between the topside facility and the installation, and mounting a repeater on the line.

7. A method according to claim 6, wherein the repeater draws power from the line between the upside facility and the installation.

8. A method according to claim 6, wherein the repeater draws power from an associated battery.

9. A method according to claim 1, wherein each of the plurality of RF communication devices comprises an associated battery.

10. A hydrocarbon extraction plant having an underwater hydrocarbon extraction installation including at least one hydrocarbon extraction well with an associated tree, the plant comprising a radio frequency (RF) communication arrangement, comprising:

a plurality of RF communication devices provided at respective components of the installation, the components of the installation comprising:

a subsea control module (SCM) at the tree a sensor at the tree;

a topside facility; and a remote operation vehicle, the plurality of RF communication devices comprising:

an RF antenna at the SCM;

an RF antenna at the sensor;

an RF antenna at the topside facility; and an RF antenna at the remote operation vehicle, the RF communication arrangement providing for communication of the topside facility with the SCM, communication of the sensor with the SCM, and communication of the remote operation vehicle with the SCM or the sensor.

11. A plant according to claim 10, wherein said components of the installation comprise each of the following: the SCM at the tree, a manifold to couple output of a plurality of wells, the sensor located at the tree, a downhole device located in the installation, the remote operation vehicle, and the topside facility.

12. A plant according to claim 11, wherein one of said components of the installation comprises a sensor located at a manifold to couple output of a plurality of wells.

13. A plant according to claim 11, wherein one of said components of the installation comprises a sensor located at the installation, and wherein the sensor measures seismic activity.

14. A plant according to claim 11, wherein one of said components of the installation comprises a downhole device located in the installation, and wherein the downhole device comprises a choke.

15. A plant according to claim 11, wherein each of the RF communication devices comprises an associated battery.

16. A method according to claim 6, wherein one of said components of the installation comprises the remote operation vehicle (ROV), and wherein the ROV is configured to provide higher data rates than can be provided using the repeater, thereby providing for one or more of the following: software updates and emergency well control using the ROV.

17. A plant according to claim 10, further comprising:

a line positioned between the topside facility and the installation, and a repeater mounted on the line.

18. A plant according to claim 17, wherein the repeater and the line between the topside facility and the installation are configured so that the repeater draws power from the line.

19. A plant according to claim 17, wherein the plurality of RF communication devices comprise a battery associated with the repeater, the repeater configured to draw power from the associated battery.

* * * * *

UNITED STATES PATENT AND TRADEMARK OFFICE

CERTIFICATE OF CORRECTION

PATENT NO. : 8,581,741 B2
APPLICATION NO. : 12/936226
DATED : November 12, 2013
INVENTOR(S) : Simpson et al.

It is certified that error appears in the above-identified patent and that said Letters Patent is hereby corrected as shown below:

In the Claims

In Column 6, Line 12, in Claim 10, delete “tree” and insert -- tree; --, therefor.

Signed and Sealed this
Twentieth Day of May, 2014

Michelle K. Lee

Michelle K. Lee
*Deputy Director of the United States Patent and Trademark Office*